United States Patent [19]

Odashima et al.

[11] Patent Number: 4,609,594

[45] Date of Patent: Sep. 2, 1986

[54] PROCESS FOR PRODUCING COLD ROLLED STEEL STRIP HIGHLY SUSCEPTIBLE TO CONVERSION TREATMENT AND PRODUCT THEREOF

[75] Inventors: Hisao Odashima; Takao Saito; Yoshihiko Hirano, all of Himeji, Japan

[73] Assignee: Nippon Steel Corporation, Tokyo, Japan

[21] Appl. No.: 631,169

[22] Filed: Jul. 16, 1984

[30] Foreign Application Priority Data

Jul. 19, 1983 [JP] Japan ..... 58-131584

[51] Int. Cl.[4] ..... C25D 11/02; C25D 7/06

[52] U.S. Cl. ..... 428/629; 148/6.15 R; 204/28; 204/37.6; 204/38.3; 428/195; 428/659

[58] Field of Search ..... 204/28, 29, 37.6, 38.3, 204/42, 140, 145 R; 428/629, 632, 633, 659, 469, 195, 687; 148/6.15 R

[56] References Cited

U.S. PATENT DOCUMENTS 2,827,425 3/1958 McGlasson et al. ..... 204/37.6
4,391,685 7/1983 Shepard et al. ..... 204/145 R
4,432,845 2/1984 Ogata et al. ..... 204/56 R
4,437,947 3/1984 Saito et al. ..... 204/35.1
4,522,892 6/1985 Shindow et al. ..... 428/628

*Primary Examiner*—John F. Niebling
*Assistant Examiner*—William T. Leader
*Attorney, Agent, or Firm*—Kenyon & Kenyon

[57] ABSTRACT

A cold rolled steel strip having an excellent conversion coating property is produced by a process comprising:

anodic electrolytically treating at least one non-plated surface of a cold rolled steel strip to form a layer of oxides thereon, and cathodic electrolytically treating the above-mentioned surface to remove a portion of the oxide layer to an extent that the remaining portion of the oxide layer is in an amount corresponding to a quantity of electricity of from 0.05 to 4.0 millicoulomb/cm$^2$ which is necessary to completely remove the remaining portion of the oxide layer by means of a cathodic electrolytic treatment in an aqueous solution containing 19.06 g/l of borax and having a pH of 6.4 at a constant current density of 5 microampere/cm$^2$ and is in the form of a number of separate dots corresponding to a natural reduction time of from 1.0 to 200 seconds.

6 Claims, 16 Drawing Figures

2
2a
1

2b
1

2c
1

2d
1

5A
4
5B

PROCESS FOR PRODUCING COLD ROLLED STEEL STRIP HIGHLY SUSCEPTIBLE TO CONVERSION TREATMENT AND PRODUCT THEREOF

BACKGROUND OF THE INVENTION

1. Field of the Invention

The present invention relates to a process for producing a cold rolled steel strip highly susceptible to conversion treatment. More particularly, the present invention relates to a process for enhancing a conversion treatment property of at least one non-plated surface of a cold rolled steel strip. In that, the cold rolled steel strip produced in accordance with the present invention provides at least one non-plated surface thereof exhibiting an enhanced conversion treatment property, for example, an enhanced phosphate-coating property and lacquering property. The phosphate-coated, laquered surface exhibits an excellent resistance to corrosion.

2. Description of the Prior Art

Usually, a cold rolled steel strip is produced by descaling a hot rolled steel strip by means of pickling, and by then cold rolling the descaled hot rolled steel strip. In order to enhance certain properties, for example, the phosphate-coating property and lacquering property, of the cold rolled steel strip, the cold rolled steel strip is surface-cleaned, for example, by means of an electrolytic degreasing method, and is then introduced into a batch type box-annealing furnace. In the furnace, the degreased steel strip is heated to a recrystallization temperature of the steel strip or more, is soaked at the above-mentioned temperature, and is then cooled in a reducing gas atmosphere to a temperature at which the steel strip surface is not oxidized. The cooled steel strip is removed from the annealing furnace and is additionally cooled to a temperature at which steel strip is not aged. The cooled steel strip is then subjected to a temper rolling procedure.

The above-mentioned conventional process is disadvantageous in productivity and in economical efficiency not only in that the process includes a number of steps and therefore, complicates the handling of the connections between the steps, but also in that since the steel strip is coiled in the box-annealing furnace and the coil is subjected to the heating, soaking, and cooling steps, a long period of time is necessary to complete the annealing procedure.

Accordingly, it is desired that above-mentioned steps after the cold rolling step be made concise and continuous and that the productivity and economical efficiency of the steps be improved.

In recent years, various approaches have been tried for making the above-mentioned annealing steps continuous so as to produce a cold rolled steel strip having an enhanced workability at a high economical efficiency. In these approaches, a cold rolled steel strip is heated at a recrystallizing temperature thereof or more, is primarily cooled to a predetermined temperature, is then overaged at a predetermined temperature for a predetermined time, and finally, is secondarily cooled to a room temperature, so as to control the thermal history of the steel strip to a predetermined pattern thereof.

Generally, it is possible to produce a cold rolled steel strip at a high efficiency by using a continuous annealing process. However, the conventional continuous annealing process is disadvantageous in that even if the annealing procedure is continuously carried out in a reducing gas atmosphere by heating a steel strip by means of a heat-radiation tube type continuous annealing furnace, and by cooling it by means of a cooling jet, the phosphate-coating property of the resultant steel strip is not so good as that of the steel strip annealed by means of a batch type box annealing furnace.

Especially, when the annealing process is carried out by a combination of a rapid heating operation by means of a direct heating furnace with a rapid cooling operation by means of a cooling medium consisting of a gas and water or of cooling water, the resultant steel strip exhibits an unsatisfactory phosphate-coating property. The direct heating furnace heating operation and the gas-water cooling or water cooling operation are carried out substantially in an oxidizing atmosphere, and therefore, the surface of the steel strip is oxidized in the heating operation and in the cooling operation.

Accordingly, it is necessary that in a certain stage of the continuous annealing step, the steel strip is subjected to a step in which the resultant layer of oxides is removed from the steel strip surface. However, it should be noted that even when the oxide layer produced in the direct heating furnace can be reduced in a soaking furnace at an elevated temperature, the reduced surface of the steel strip is re-oxidized in the cooling step and the resultant oxide layer cannot be reduced in the overaging step, which is carried out at relatively low temperature. Therefore, it is difficult to shorten the continuous annealing process. Also, if the reduction of the oxide layer is carried out incompletely, the resultant steel strip surface exhibits an unsatisfactory phosphate-coating property and, therefore, an unsatisfactory lacquering property, and the resultant lacquered steel strip exhibits a poor resistance to corrosion. Therefore, it is necessary that before the temper rolling process, the oxide layer is completely removed by means of pickling, abrading or grinding. These procedures cause the phosphate-coating property of the steel strip to decrease.

As a recent trend, the steel strip used for the body of car is usually a single surface plated steel strip. That is, the plated surface of the steel strip is utilized for forming portions of the surface of the car body which are not lacquered, for example, the inside surface of the core, and the non-plated surface of the steel strip is utilized to form the other portions of the car body surface, for example, the outside surface thereof, which are easily lacquered. The single surface-plated steel strip is produced by plating a single surface of a steel strip with a zinc-based alloy by means of a hot valcanizing or electroplating method. Usually, the electroplating method is used for the production of the single surface-plated steel strip, because in the electroplating method the steel strip can be processed various ways.

In the production of the single surface-plated steel strip, a steel strip is immersed in a plating liquid and is placed between an upper electrode and a lower electrode. When an electric current is applied between the steel strip and the lower electrode and no current is applied between the steel strip and the upper electrode, only the lower surface of the steel strip is plated and upper surface of the steel strip is retained as non-plated. However, in the above-mentioned single surface-plate method, the non-plated upper surface of the steel strip is undesirably polluted with a small amount of plating metal deposited thereon. Also, in the water-rinsing, hot water-rinsing, and drying steps, the upper surface of the steel strip is polluted with oxides or hydroxides. Usually, the small amount of plating metal deposited on the non-plated surface is in the amorphous or semi-amorphous state. Therefore, when a conversion treatment is applied to the polluted non-plated surface of the steel strip, the plating metal layer hinders the formation of a regular coating layer and causes undesirable coating defects to be formed.

There are various approaches to the removal of the undesirable deposits from the non-plated surface of the steel strip. For example, a brushing operation is applied to the polluted non-plated surface. However, this operation is unsatisfactory in that it does not completely remove the deposits from the non-plated surface.

In another approach, Japanese Unexamined Patent Publication (Kokai) No. 59-70792 discloses a process for removing the deposits from the non-plated surface of a steel strip by means of an anodic electrolytical treatment in a specific electrolyte solution containig a specific amount of a surface active agent. This anodic electrolytical treatment should be carried out at a neutral pH range of from 4 to 10. If the anodic electrolytical treatment is carreid out in a strong acid range or strong alkaline range of pH, a portion of the iron in the steel strip is dissolved together with the deposits in the electrolytic liquid. This phenomenon results in etching of the non-plated surface of the steel strip and in degradation of the elecyrolytic liquid by the dissolved iron ($Fe^{++}$). When the anodic electrolytic treatment is carried out in a neutral pH range, the non-plated surface of the steel strip matrix is covered with a passive state layer, that is, an oxide layer, and therefore, no iron ($Fe^{++}$) is dissolved in the electrolytic liquid. That is, no etching of the non-plated surface and substantially no degradation of the electrolytic liquid occurs. That is, when the non-plated surface of the steel strip is subjected to anodic electrolytic treatment, a passive state (oxide) layer is formed on the non-plated surface. Usually, this passive state layer does not obstruct the conversion treatment, for example, phosphate-coating process. However, where a high purity steel strip or a steel strip containing at least one element selected from titanium, niobium and boron is subjected to a conversion treatment, the passive state layer will sometimes obstract the conversion treatment so as that, for example, the formation of the phosphate-coating layer is hindered. Especially, when the conversion treatment is carried out by means of spraying or dipping method, and the conversion treatment liquid is partially degraded, the passive state layer hinders the conversion treatment.

In any type of steel strip, in any type of conversion treatment liquid, and in any type of production line, the conversion coating must be always stably formed.

Japanese Unexamined Patent Publication (Kokai) No. 58-133395 discloses a process for removing black substances consisting of amorphous oxides and hydroxides from the non-plated surface of a steel strip which has been plated on a single surface thereof. In this process, the non-plated surface is subjected to an anodic electrolytic treatment in aqueous solution containing at least one member selected from sulfuric acid, hydrochloric acid, perchloric acid, carobonic acid, boric acid, and nitric acid, and at least one member selected from sodium hydroxide, potassium hydroxide, said perchloric acid, carbonic acid, boric acid, and nitric acid, and at least one member selected from sodium hydroxide, patassium hydroxide, and ammonium hydroxide, at a pH of from 3 to 9 and at an anode current density of 5 $A/dm^2$. In this anodic electrolytic treatment, a passive state layer (oxide layer) is naturally formed on the non-plated surface of the steel strip and, sometimes, hinders the conversion treatment.

SUMMARY OF THE INVENTION

An objective of the present invention is to provide a process for producing a cold rolled steel strip highly susceptible to conversion treatments.

The above-mentioned objective can be attained by the process of the present invention comprising the steps of:

applying an anodic electrolytic treatment to at least one non-plated surface of a cold rolled steel strip to form a layer of oxides on the non-plated surface; and then, applying an cathodic electrolytic treatment to the anodic electrolytically treated surface of the cold rolled steel strip to remove a portion of the oxide layer to an extent that the remaining portion of the oxide layer is in an amount corresponding to quantity of electricity of from 0.05 to 4.0 $millicoulomb/cm^2$, which is necessary to completely dissolve the remaining portion of the oxide layer by means of a cathodic electrolytic treatment in an aqueous solution containing 19.06 g/l of borax and having a pH of 6.4, at a constant current density of 5 $microampere/cm^2$, and is in the form of a number of dots separate from each other, corresponding to a natural reduction time of from 1.0 to 200 seconds.

The surface of the cold rolled steel strip treated in accordance with the process of the present invention exhibits an excellent stable chemical conversion coating property, for example, a superior stable phosphate coating property.

DESCRIPTION OF THE PREFERRED EMBODIMENTS

During the study made by the inventors of the present invention into the chemical conversion treatmnet for cold rolled steel strip, it became clear that the chemical conversion coating property of the surface of the steel strip is variable depending on the amount and distribution of layers comprising oxides (and hydroxide) and formed on the steel strip surface.

The amount of the oxide layer is represented by a quantity of electricity in millicoulomb/cm$^2$ necessary to completely dissolve the oxide layer by means of a cathodic electrolytic treatment in an aqueous solution containing 19.06 g/l of borax and having a pH of 6.4 at a constant current density of 5 microampere/cm$^2$. The pH of the borax solution can be controlled by adding an aqueous solution of hydrochloric acid.

The distribution of the oxide layer on the steel strip surface is represented by a natural reduction time in second of the oxide layers. The natural reduction time is measured in such a manner that the steel strip having the oxide layer is immersed in an electrolyte aqueous solution, for example, a borade aqueous solution or an electrolyte neutral aqueous solution containing boric acid and sodium sulfate or sodium carbonate, the electric potential of the surface is measured while no electric current flows and the time period between the stage of immersion and the stage at which the surface potential becomes the same as that of iron is determined.

Figure 1:
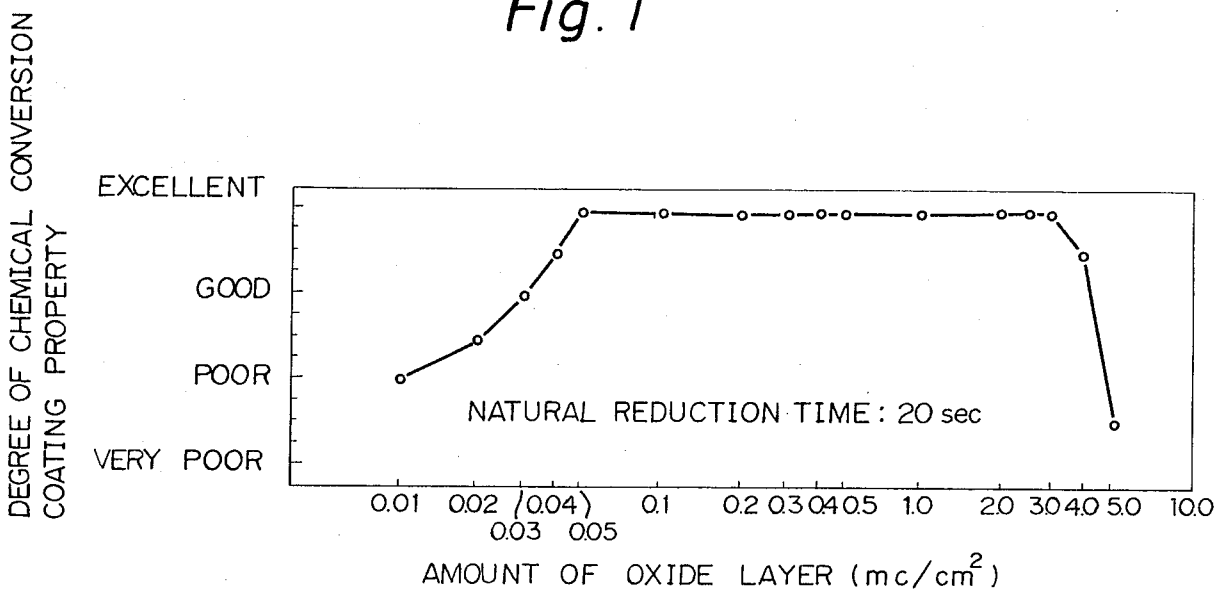
FIG. 1 is a graph showing a relationship between an amount of oxide layer, in terms of quantity of electricity necessary to remove oxide layer by means of a cathodic electrolytic treatment, remaining on a non-plated surface of a cold rolled steel strip and the degree of chemical conversion coating property of the non-plated surface.

FIG. 1 shows a relationship between the amount of oxide layers on a steel strip surface and the degree of chemical conversion coating property of the steel strip surface. The oxide layers exhibited a natural reduction time of 20 seconds.

FIG. 1 shows that the chemical conversion coating property of the steel strip surface is excellent when the amount of oxide layer on the steel strip surface is in the range of from 0.05 to 4.0 mc/cm$^2$. When the amount of the oxide layer is less than 0.05 mc/cm$^2$, the formation of chemical conversion coating becomes poor and the amount of the resultant coating is undesirably small. When the amount of the oxide layer is more than 40 mc/cm$^2$, the resultant chemical conversion coating layer contains yellow rust or defects.

Accordingly, in order to obtain a satisfactory chemical conversion coating property, the amount of the oxide layer should be controlled into a range of from 0.05 to 4.0 mc/cm$^2$.

Figure 2:
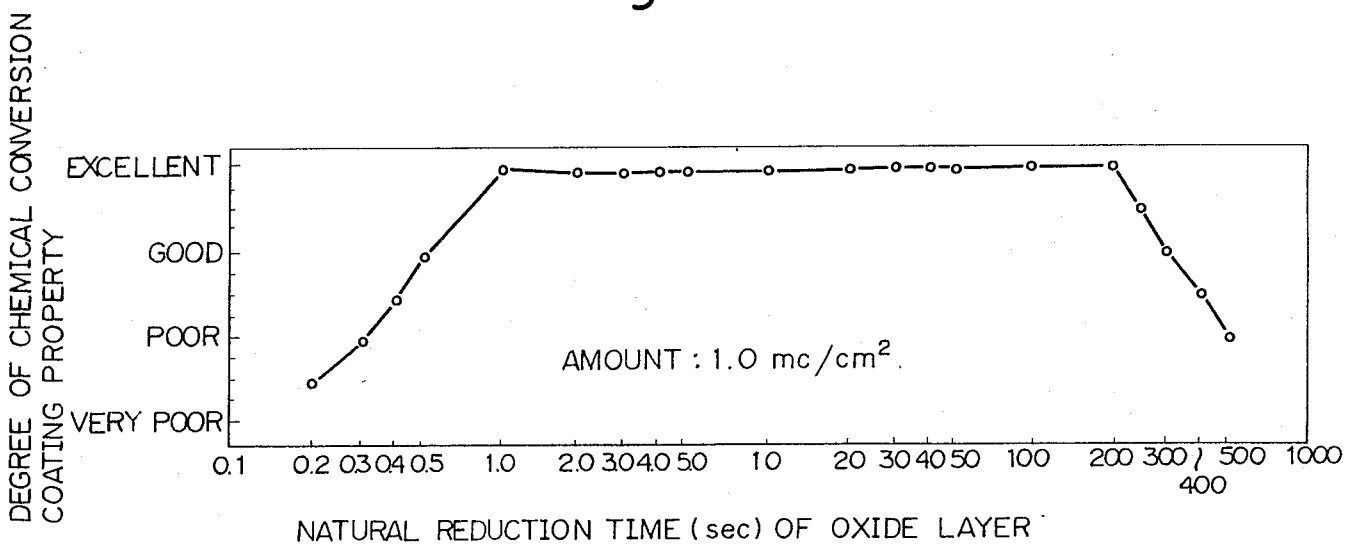
FIG. 2 is a graph showing a relationship between distribution of the oxide layer, represented by terms of natural reduction time, remaining on a non-plated surface of a cold rolled steel strip and the degree of chemical conversion coating property of the non-plated surface.

FIG. 2 shows a relationship between a natural reduction time of oxide layer formed on a steel strip surface and the chemical conversion coating property of the steel strip surface. The amount of the oxide layer is 1.0 mc/cm$^2$.

Referring to FIG. 2, it is clear that in order to obtain a satisfactory chemical conversion coating property, the natural reduction time of the oxide layer on the steel strip surface should be in the range of from 1 to 200 seconds.

When the natural reduction time is in the range of from 1 to 200 seconds, the oxide layer is distributed in the form of a number of dots separated from each other on the steel strip surface.

If the natural reduction time of the oxide layer on a steel strip surface is less than one second, the steel strip surface exhibits an unsatisfactory chemical conversion coating property and the amount of the resultant coating is undesirably small. If the natural reduction time of the oxide layer of a steel strip surface is more than 200 seconds, the chemical conversion coating property of the steel strip surface is poor and the resultant coating contains yellow rust spots and other defects.

Accordingly, it should be noted that in order to obtain a steel strip surface having a satisfactory chemical conversion coating property, it is necessary that the oxide layer remaining on the steel strip surface is not only in an amount of 0.01 to 4.0 mc/cm$^2$ but also, in the form of a number of dots separate from each other, correspond to a natural reduction time of 1 to 200 seconds.

As long as the above mentioned two features are satisfied, the steel strip surface exhibits a satisfactory chemical conversion coating property in any type of conversion treatment liquid, in any type of conversion procedure, for example, spraying or dipping conversion treatment, and in any type of steel strip.

Figure 3:
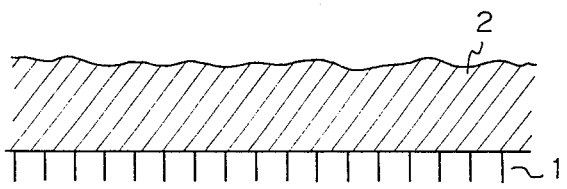
FIG. 3 is an explanatory cross-sectional view of an embodiment of the oxide layer.

Referring to FIG. 3, a surface of a steel strip 1 is completely coated with a large amount of an oxide layer 2. In this coating, the oxide layer hinders desirable dissolution of $Fe^{++}$ from the steel strip surface 1 and desirable production of crystals of conversion coating material, for example, phosphate.

Even if a certain amount of crystals of the conversion coating material is produced, the oxide layer obstructs the growth of the crystals and causes undesirable yellow rust spots to be formed on the coating.

Figure 4:
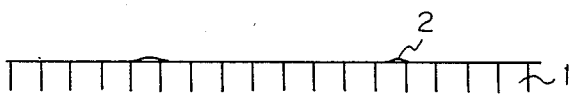
FIG. 4 is an explanatory cross-sectional view of another embodiment of the oxide layer.

Referring to FIG. 4, a very small amount of oxide layer 2 is formed in the form of dots on a surface of a steel strip 1. The very small amount of oxide layer 2 is not effective for promoting the formation of the chemical conversion coating. That is, each crystal of the chemical conversion coating material is formed and grows around a crystallization nucleus. The oxide layer on the steel strip surface serves as a crystallization nucleus. Therefore, when the number of oxide layers in the form of dots is small as shown in FIG. 4, the formation and growth of the crystals of the conversion coating material is poor.

Figure 5:
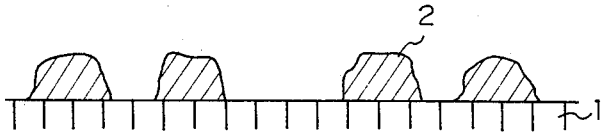
FIG. 5 is an explanatory cross-sectional view of still another embodiment of the oxide layer.

If the oxide layers are distributed in the form of a number of dots in an adequate density, as shown in FIG. 5 on the steel strip surface 1, each oxide layer 2 serves as a crystallization nucleus and promotes the formation and growth of crystals of the conversion coating material.

Figures 6A, 6B, 7A, 7B, 8:
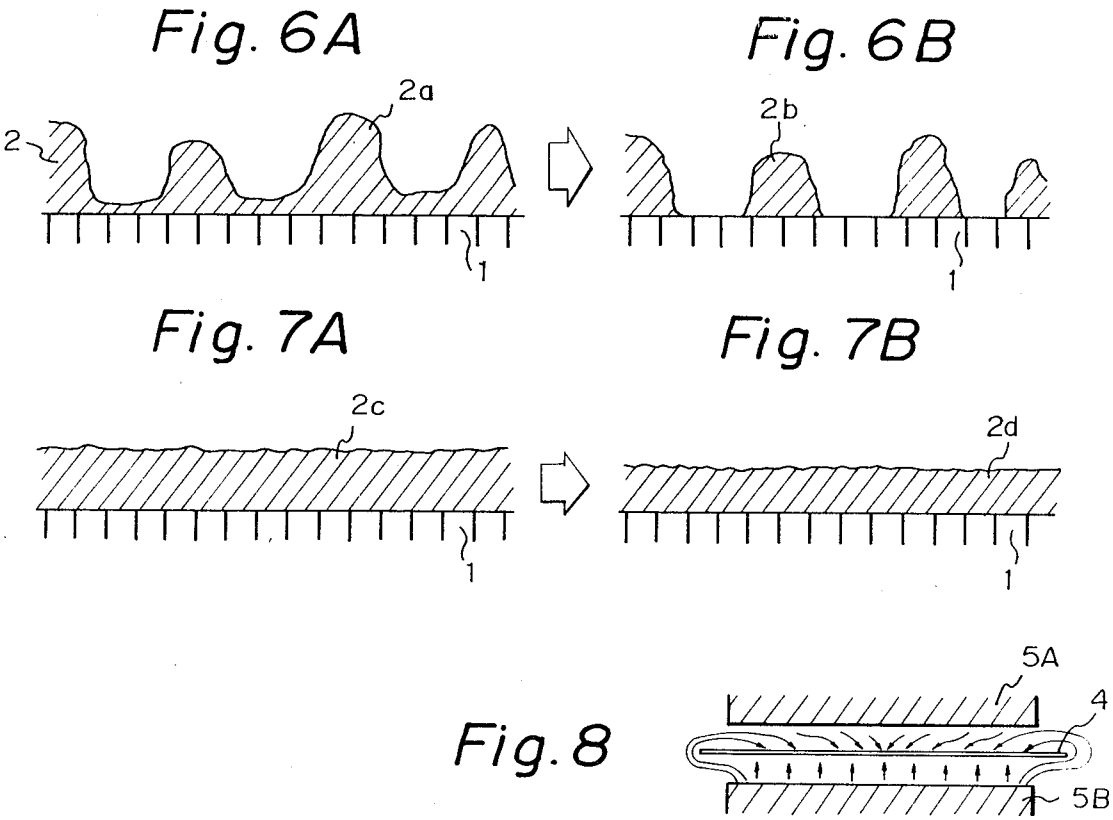
FIG. 6A is an explanatory cross-sectional view of an embodiment of an oxide layer formed by an anodic electrolytic treatment.
FIG. 6B is an explanatory cross-sectional view of an embodiment of an oxide layer after the oxide layer in FIG. 6A is subjected to a cathodic electrolytic treatment in accordance with the process of the present invention.
FIG. 7A is an explanatory cross-sectional view of another embodiment of cross-sectional view of another embodiment of the oxide layer formed by an anodic electrolytic treatment.
FIG. 7B is an explanatory cross-sectional view of an embodiment of the oxide layer after the oxide layer shown in FIG. 7A is subjected to a cathodic electrolytic treatment in accordance with a process other than that of the present invention.
FIG. 8 is an explanatory cross-sectional profile of an apparatus for plating a single surface of a steel strip by means of an electroplating method.

Referring to FIG. 6A, a steel strip surface 1 is covered with a continuous oxide layer 2 having a number of projections 2*a*. When the continuous oxide layer 2 is partially removed, the continuous layer 2 is converted to a number of oxide layers 2*b* separate from each other, as shown in FIG. 6B, so that portions of the steel strip surface are exposed to the outside. The separate oxide layers 2*b* in FIG. 6B correspond to the projections 2*a* in FIG. 6A had are effective as nucleus for producing and growing crystals of the conversion coating material. Also, $Fe^{++}$ can be released from the exposed portion of the steel strip surface. The release of $Fe^{++}$ is necessary to promote the production and growth of crystals of the conversion coating material on the steel strip surface.

The natural reduction time of the oxide layer on the steel strip surface is a parameter representing how easily the portion of the oxide layer is removed and the portion of the steel strip surface expored to the outside as so to allow $Fe^{++}$ to be released from the exposed surface.

Referring to FIG. 7A, a steel strip surface 1 is completely covered with a continuous flat oxide layer 2*c*. In this flat oxide layer 2*c*, even if a portion of the oxide layer 2*c* is removed, see FIG. 7B, the remaining oxide layer 2*d* still completely covers the steel strip surface 1.

Therefore, when the steel strip as shown in FIG. 7B is subjected to a chemical conversion treatment, the oxide layer 2*d* hinders the release of $Fe^{++}$ from the steel strip. Also, the flat oxide layer 2*d* cannot serve as a nucleus. Therefore, the steel strip surface having the flat oxide layer as shown in FIG. 7B is not susceptible to the conversion treatment.

The process of the present invention can be applied to a non-plated surface of a single surface-plated cold rolled steel strip.

Referring to FIG. 8, in the usual electroplating process a steel strip 4 is placed between an upper electrode 5A and a lower electrode 5B in an electroplating liquid containing a plating metal, and both surfaces of the steel strip are electroplated by flowing an electric current between the steel strip and the upper electrode 5A and between the steel strip and the lower electrode 5B. When only a lower surface of the steel strip is to be plated, the electric current flows only between the steel strip and the lower electrode 5B. In this electroplating process, small portions of the electric current flow to the upper surface of the steel strip 4, as shown by arrows in FIG. 8, and the upper surface is polluted by deposits of the plating metal. These deposits should be removed.

The process of the present invention is effective for removing the metal deposits from the non-plated surface while the conversion coating property of the steel strip surface is enhanced.

The single surface of the steel strip is usually plated with zinc or a zinc alloy, for example, zinc-nickel, zinc-nickel-cobalt, iron-nickel, iron-zinc-nickel, zinc-aluminum, zinc-manganese, and zinc-titanium.

Also, the process of the present invention can be applied to at least one surface of a cold rolled steel strip which has been continuously annealed.

In a usual continuous annealing process, it is necessary to complete a heat cycle within a short time. Therefore, after the heating and soaking steps, the steel strip is cooled within a short time by means of a rapid cooling method, for example, a gas-liquid mixture cooling method. The rapid cooling procedure results in forming a large amount of the oxide (scale) layer on the steel strip surface. The oxide layer is removed by means of, for example, pickling, at the final stage of the continuous annealing process.

When the rapid cooling procedure is carried out by means of a roll cooling method, the amount of oxides produced during the cooling step is very much smaller than that in the box annealing process.

That is, the steel strip surface fed from the continuous annealing process has a very small amount of oxide layer, as shown in FIG. 4. Therefore the surface of the continuously annealed steel strip exhibits a poor conversion coating property.

However, when the process of the present invention is applied, the resultant surface of the continuously annealed steel strip exhibits an excellent conversion coating property.

In the process of the present invention, an anodic electrolytic treatment is applied to a non-plated surface of a cold rolled steel strip to form an oxide layer on the surface thereof. Thereafter, an cathodic electrolytic treatment is applied to the anodic electrolytically treated surface to remove a portion of the oxide layer to an extent that the remaining portion of the oxide layer is in an amount of 0.05 to 4.0 millicoulomb/$cm^2$ and in the form of a number of separate dots corresponding to a natural reduction time of 1 to 200 seconds.

Figure 9:
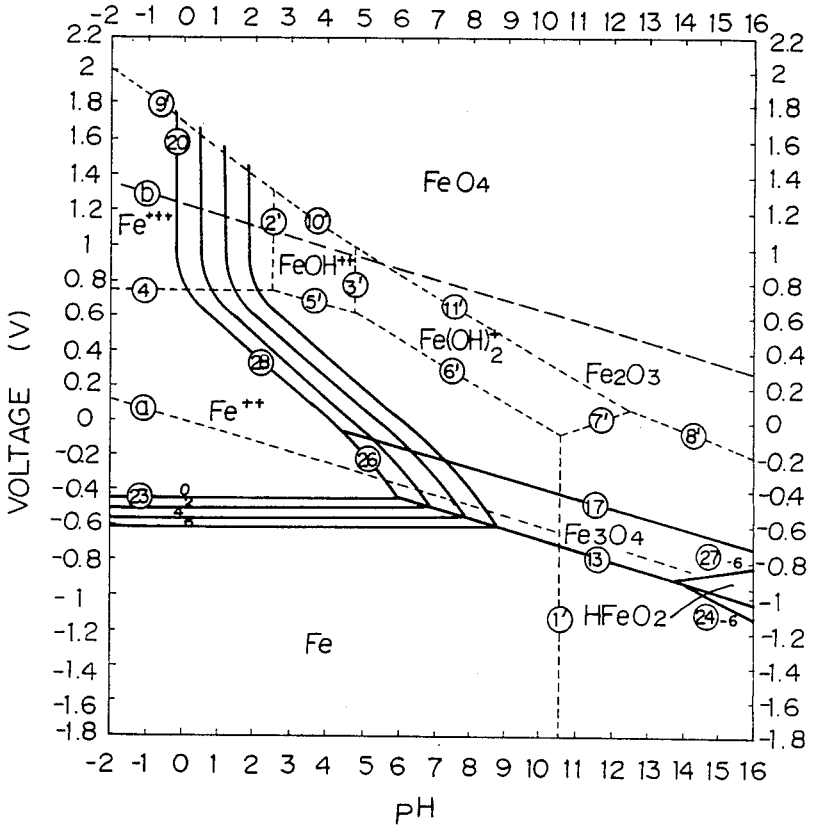
FIG. 9 is a diagram showing a relationship among pH of an electrolytic liquid, voltage applied to a non-plated surface of a cold rolled steel strip, and the type of oxide produced on the non-plated surface.

FIG. 9 shows the relationship among the pH of an electrolytic liquid in which a steel strip is immersed, the voltage applied to the steel strip, and the type of oxides produced on the surface of the steel strip.

The anodic electrolytic treatment can be carried out in accordance with conventional methods.

Figure 10:
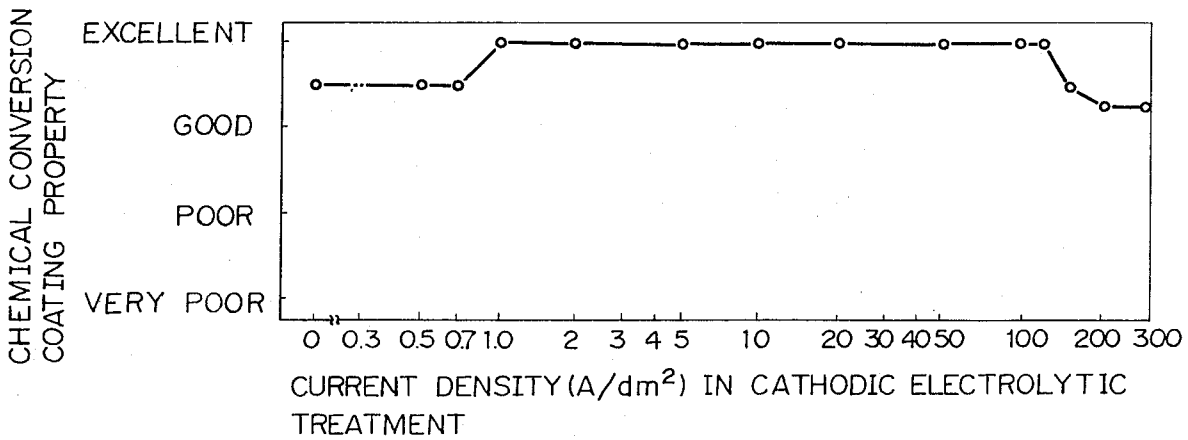
FIG. 10 is a graph showing a relationship between the current density applied to a non-plated surface of a cold rolled steel strip in a cathodic electrolytic treatment and the degree of chemical conversion coating property of the resultant non-plated surface.

The cathode electrolytic treatment is preferably carried out at a current density of from 1 to 120 A/$dm^2$ with a quantity of electricity of 0.1 to 150 coulomb/$dm^2$ Referring to FIG. 10, when the current density is in the range of from 1 to 120 A/$dm^2$, the resultant steel strip surface exhibits an excellent chemical conversion coating property. If the current density is less than 1 A/$dm^2$, the reduction of the oxide layer in a passive state is unsatisfactory. If the current density is more than 120 A/$dm^2$, hydrogen gas is generated and the efficiency of the reduction becomes unsatisfactory.

Figure 11:
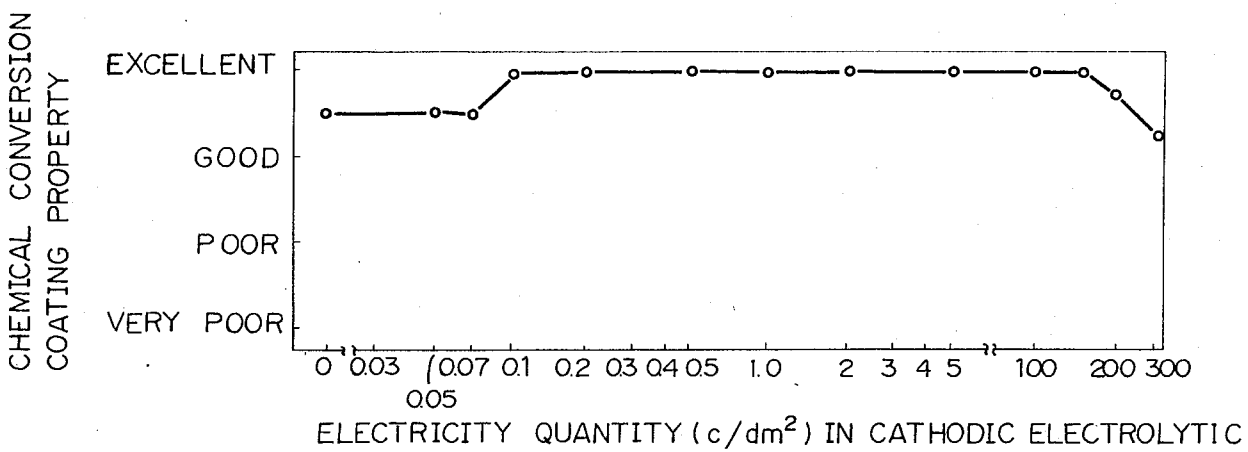
FIG. 11 is a graph showing a relationship between the quantity of electricity applied to a non-plated surface of a cold rolled steel strip in a cathodic electrolytic treatment and the degree of chemical conversion coating property of the resultant non-plated surface.

Referring to FIG. 11, it is preferable that the cathodic electrolytic treatment is carried out with a quantity of electricity of 0.1 to 150 C/$dm^2$. When the electricity quantity is less than 0.1 C/$dm^2$, the reduction of the oxide layer in a passive state is unsatisfactory. Also, when the electricity quantity is more than 150 C/$dm^2$, the oxide layer is excessively removed, as shown in FIG. 4, and therefore, the resultant steel strip surface exhibits a poor chemical conversion coating property.

The cathodic electrolytic treatment liquid may be the same as the anodic electrolytic treatment liquid. That is, the electrolytic liquid may be an aqueous solution containing at least one electrolyte, for example, selected from sodium sulfate ($Na_2S0_4$), sodium carbonate ($Na_2CO_3$), potassium sulfate ($K_2SO_4$), potassium carbonate ($K_2CO_3$), sodium dihydrogen phosphate ($NaH_2PO_4$), disodium hydrogen phosphate ($Na_2HPO_4$), trisodium phosphate ($Na_3PO_4$), and phosphoric acid ($H_3PO_4$)

The electrolytic liquid preferably has a neutral pH of from 3 to 10, more preferably, 3.5 to 10. If the pH is less than 3, the resultant steel strip surface sometimes contains yellow rust spots. If the pH is more than 10, an undesirable hydroxides layer is sometimes formed on the resultant steel strip surface. Generally, it is known that a high purity steel strip is not susceptible to conversion treatment, because a dense oxide layer is formed on the high purity steel strip surface and hinders the formation and growth of crystals of the conversion coating material. Also, it is known that a steel strip containing at least one member selected from titanium ($T_1$), niobium (Nb), and boron (B) exhibits a remarkably decreased conversion coating property, because titanium, niobium, and boron contained in the steel strip promote the formation of a dense oxide layer on the steel strip layer. This dense oxide layer results in a decreased conversion coating property of the steel strip surface.

However, the process of the present invention can enhance the conversion coating property of the high purity steel strip and the steel strip containing at least one member selected from Ti, Nb, and B.

For example, a non-plated surface of a Ti-containing extremely low carbon steel strip was subjected to an anodic electrolytic treatment. The non-plated surface was polluted with 75 mg/m$^2$ of zinc and 115 mg/m$^2$ of nickel. The treatment was carried out in an electrolytic solution containing 200 g/l of $NaH_2PO_4$ and 0.1% by weight of an amine type surfactant at a pH of 5.0 and at a current density of 40 A/dm$^2$ for 4 seconds. The resultant anodically treated surface which was free from zinc and nickel, was subjected to a cathodic electrolytic treatment in the same electrolytic solution as that mentioned above, at a current density of 10 A/dm$^2$ The resultant surface had oxide layers in an amount of 0.3 mc/cm$^2$ and in a natural reduction time of 9 seconds and exhibited an excellent conversion coating property, although the steel strip contained 0.055% by weight of titanium.

The process of the present invention may be continuously carried out in an electroplating process line. For example, referring to FIG. 12, a electroplating process line comprising a pay-off reel 21, a welder 22, an inlet accumulator 23, a brush scrubber 24, a degreasing vessel 25, a water sprayer 26, a pickling vessel 27, a water sprayer 28, and an electroplating vessel 29, is connected, through a brush scrubber 30, to a line for the process of the present invention consisting of an anodic electrolytic treatment vessel 31 and a cathodic electrolytic treatment vessel 32, and then to a finishing process line comprising a water sprayer 33, a dryer 34, an outlet accumulator 35, an oiler 36, and a tension reel 37.

Figure 12:
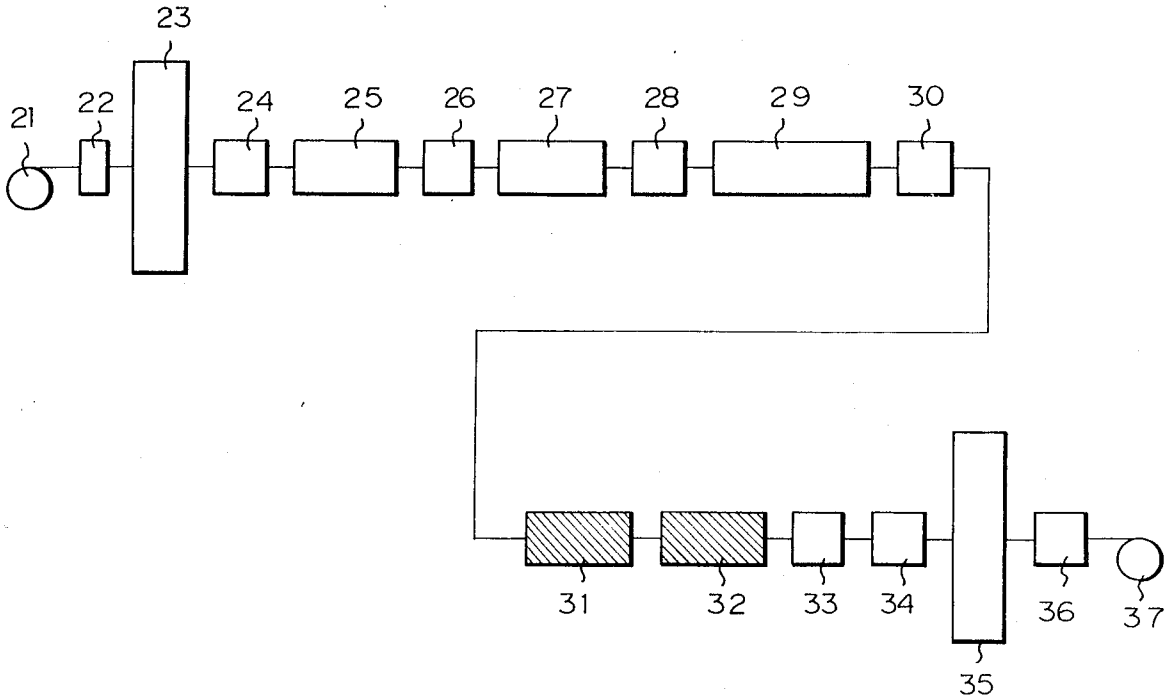
FIG. 12 shows an embodiment of an apparatus for applying the process of the present invention to a non-plated surface of a cold rolled steel strip just after the other surface of the steel strip is plated.

The process line as shown in FIG. 12 is effective for enhancing the conversion coating property of not only the non-plated surface but also the plated surface of a single surface-plated steel strip.

In the process line as shown in FIG. 12, the cathodic electrolytic treatment vessel 32 may be omitted. In this type of process line, an anodically treated steel strip, which has been passed through the water sprayer 33, the dryer 31, the outlet accumulator 32, the oiler 33, and the tension reel 34, is fed to a lacquering process line in which a cathodic electrolytic treatment vessel is arranged upstream to a conversion treatment vessel and a lacquering equipment.

Also, a single surface-plated steel strip may be fed to a process line in which an anodic electrolytic treatment vessel is arranged at the inlet of the line and is connected to a cathodic electrolytic treatment vessel arranged upstream to a conversion treatment vessel and a lacquering equipment.

In the process of the present invention, the anodic electrolytic treatment and the cathodic electrolytic treatment may be carried out either in one vessel or in two separate vessels.

The process of the present invention may be carried out within a process line containing a conversion treatment and lacquering process.

Figure 13:
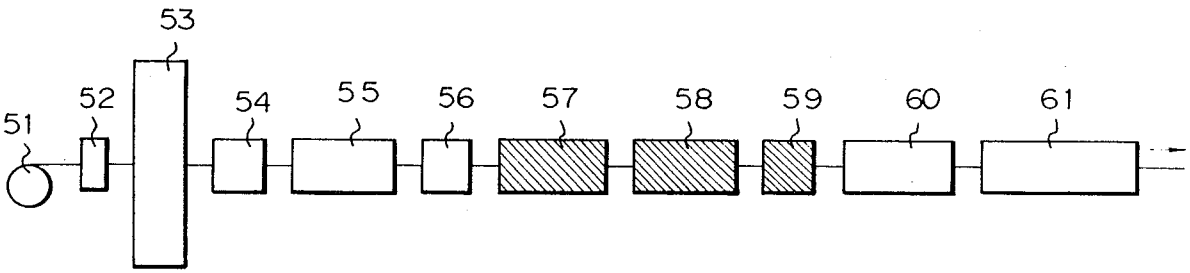
FIG. 13 shows an embodiment of the apparatus for applying the process of the present invention to a cold rolled steel strip and then applying a chemical conversion treatment to the cold rolled steel strip.

Referring to FIG. 13, a pre-treatment process line comprising a pay off reel 51, a welder 52, a inlet accumulator 53, a brush scrubber 54, a degreasing vessel 55, and a water spray 56, is followed by a process line of the present invention comprising an anodic electrolytic treatment vessel 57 and a cathodic electrolytic treatment vessel 58, and is then connected, through a water sprayer 59, to a conversion treatment equipment 60 and a lacquering equipment 61.

The process of the present invention may be carried out in a process line for continuously annealing a cold rolled steel strip.

Figure 14:
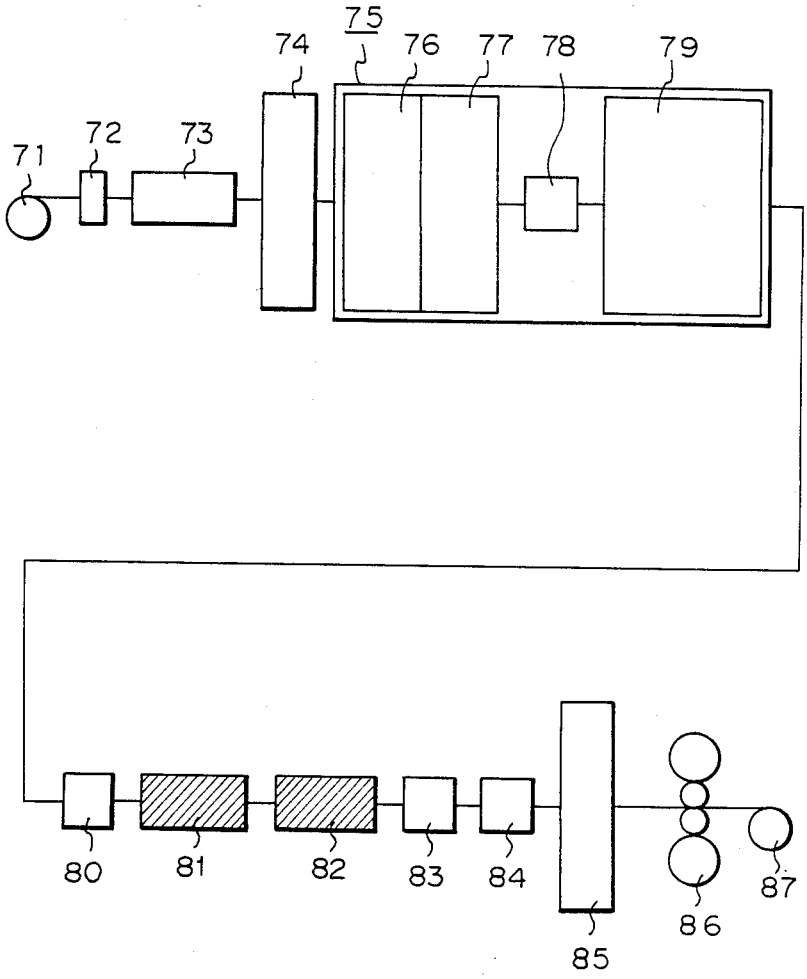
FIG. 14 shows an embodiment of the apparatus for applying the process of the present invention to a cold rolled steel strip which has been continuously annealed.

Referring to FIG. 14, a continuous annealing process line comprising a pay-off reel 71, a welder 72, a degreasing vessel 73, an inlet accumulator 74, a continuous annealing furnace 75 comprising a heating zone 76, a soaking zone 77, a cooling zone 78, and a overaging zone 79, is connected, through a brush scrubber 80, to a combination of an anodic electrolytic treatment vessel 81 and an cathodic electrolytic treatment vessel 82, and then to a finishing process line comprising a rinsing vessel 83, a dryer 84, an outlet accumulator 85, a temper-rolling machine 86, and a tension reel 87.

The features and advantages of the present invention will be illustrated by the following examples. However, it will be understood that these examples are only illustrative and in no way limit the scope of the present invention.

EXAMPLE 1

A single surface of a cold rolled steel strip having a carbon content of 0.02% by weight was electroplated with a zinc-nickel alloy. The non-plated surface of the steel strip was polluted with a small amount of a zinc and nickel-containing substance.

The non-plated surface of the steel strip was subjected to an anodic electrolytic treatment in an aqueous solution containing 200 g/l of $NaH_2PO_4$ at a pH of 5.5 and at a current density of 50 A/dm$^2$ for 2 seconds. No zinc and nickel were found on the treated surface of the resultant steal strip.

The anodic electrolytically treated surface was subjected to a cathodic electrolytic treatment in the same aqueous solution as that described above at a current density of 10 A/dm$^2$, with an electricity quantity of 20 C/dm$^2$.

The resultant steel strip surface was free from zinc and nickel and had an oxide layer in an amount of 0.5 mc/cm$^2$ and in natural reduction time of 10 seconds. The treated surface of the steel strip was subjected to a chemical conversion treatment using a commercial spray type conversion treating liquid, and the treated surface had a satisfactory conversion coating layer formed thereon.

EXAMPLE 2

The same anodic and then cathodic electrolytic treatment procedures as those described in Example 1 were applied to a non-plated single surface of a cold rolled extremely low carbon steel strip which had a content of carbon of 0.002% by weight and other surface of which had been single surface-plated with a zinc-nickel-cobalt alloy.

The resultant treated surface of the steel strip was free from zinc, nickel, and cobalt and had an oxide layer in amount of 1.0 mc/cm$^2$ and in a natural reduction time of 15 seconds. This treated surface exhibited a satisfactory conversion coating property.

EXAMPLE 3

An extremely low carbon cold rolled steel strip containing 0.04% by weight titanium and 0.0004% by weight of carbon was subjected to a single surface-electroplating process with a zinc-nickel alloy. The non-plated surface of the single surface-electroplated steel strip was subjected to the same anodic and then cathodic electrolytic treatment procedures as those described in Example 1.

The resultant treated surface of the steel strip was substantially free from zinc and nickel, had an oxide layer amount of 0.7 mc/cm$^2$ and a natural reduction time of 5 seconds, and exhibited a satisfactory conversion coating property.

EXAMPLE 4

An extremely low carbon cold rolled steel strip containing 0.03% by weight of niobium and 0.0005% by weight of carbon was single surface-electroplated with a zinc-iron alloy. The non-plated surface of the single surface-plated steel strip was subjected to the same anodic and then cathodic electrolytic treatment procedures as those described in Example 1. The resultant treated surface was substantially free from zinc, had a oxide layer amount of 1.5 mc/cm$^2$ and a natural reduction time of 20 seconds, and exhibited a satisfactory conversion coating property.

EXAMPLE 5

A cold rolled steel strip containing 0.015% by weight of carbon was degreased, pickled, and then single surface-electroplated with a zinc-nickel alloy. The plated surface had 20 g/m$^2$ of plating zinc-nickel alloy layer. The non-plated surface was polluted with 40 mg/m$^2$ of zinc deposit and 73 mg/m$^2$ of nickel deposit. The polluted, non-plated surface of the cold rolled steel strip was subjected to an anodic electrolytic treatement in an aqueous treating solution containing 200 g/l of $NaH_2PO_4$ and 0.1% by weight of an amine type surfactant at a pH of 5.5 and at an anode current density of 40 A/dm$^2$ for 2 seconds to form an oxide layer and to remove the zinc and nickel deposits, and then was subjected to a cathodic electroplating treatment in the same treating solution as mentioned above at a cathode current desity of 10 A/dm$^2$ with an electricity quantity of 10 C/dm$^2$.

The resultant treated surface of the steel strip was substantially free from the zinc and nickel deposits, had an oxide layer amount of 0.8 mc/cm$^2$ and a natural reduction time of 13 seconds, and exhibited a satisfactory conversion coating property in the same conversion treated as that described in Example 1.

EXAMPLE 6

An extremely low carbon cold rolled steel strip containing 0.038% by weight of titanium and 0.006% weight of carbon was degreased, pickled, and then single surface-electroplated with a zinc-nickel-cobalt alloy. The plated surface had 30 g/m$^2$ of a zinc-nickel-cobalt alloy layer and the non-plated surface was polluted with 70 mg/m$^2$ of zinc deposit and 128 mg/m$^2$ of nickel deposit. The non-plated surface of the steel strip was subjected to an anodic electrolytic treatment in an aqueous treating solution containing 130 g/l of $NaH_2PO_4$ and 0.15% by weight of urea type surfactant at a pH of 5.0 and at an anode current density of 50 A/dm$^2$ for 1.5 seconds. The treated surface was free from the zinc and nickel deposits. The treated surface was subjected to a cathodic electrolytic treatment in the same treating solution as that described above, at a cathode current density of 20 A/dm$^2$ with an electricity quantity of 5 C/dm$^2$.

The resultant treated surface had an oxide layer amount of 0.5 mc/cm$^2$ and a natural reduction time of 7 seconds, and exhibited a satisfactory conversion coating property.

EXAMPLE 7

An extremely low carbon cold rolled steel strip containing 0.045% by weight of titanium and 0.00055% by weight of carbon was degreased, pickled, and then single surface-electroplated with a zinc-nickel-cobalt alloy.

The plated surface had 40 g/m$^2$ of a zinc-nickel-cobalt alloy layer and the non-plated surface was polluted with 95 mg/m$^2$ of zinc deposit and 138 mg/m$^2$ of nickel deposit.

The non-plated surface of the steel strip was subjected to an anodic electrolytic treatment in an aqueous treating solution containing 200 g/l of $Na_2SO_4$ and 0.1 by weight of an amine type surfactant at a pH of 6.0 and at an anode current density of 60 A/dm$^2$ for 1.0 second. The treated surface was free from the zinc and nickel deposits.

The treated surface of the steel strip was subjected to a cathodic electrolytic treatement in the same treating liquid as that described above at a cathode current density of 20 A/dm$^2$ with an electricity quantity of 2 C/dm$^2$.

The resultant treated surface has an oxide layer amount of 0.9 mc/cm$^2$ and a natural reduction time of 13 seconds, and exhibited a satisfory conversion coating property.

EXAMPLE 9

A cold rolled steel strip containing 0.0015% by weight of carbon was degreased and continuously annealed by heating it to a temperature of 750° C. at a heating rate of 500° C./min, by soaking it at the above-mentioned temperature for 1 minutes, by cooling it to a temperature of 400° C., and they by overaging it at temperature of 400° C. for 2 minutes by means of the apparatus as indicated in FIG. 14.

The two surfaces of the continuously annealed steel strip were subjected, through a brush scrubber, to an anodic electrolytic treatment in an aqueous treating solution containing 200 g/l of $NaH_2PO_4$ and 0.2% weight of an urea type surfactant at a pH of 5.5 and at an anode current density of 40 A/dm$^2$ for 2.5 seconds, and then was subjected to a cathodic electrolytic treatment in the same treating solution as that mentioned above at a cathode current density of 20 A/dm$^2$ with an electricity quantity of 20 C/dm$^2$.

Each treated surface had an oxide layer amount of 0.6 mc/cm$^2$ and a natural reduction time of 8 seconds, and exhibited a satisfactory conversion coating property.

COMPARATIVE EXAMPLE 1

The same cold rolled steel strip containing niobium as that described in Example 4 was degreased, pickled, and then directly subjected to the same conversion treatment as that described in Example 1. The resultant conversion coating layer was defective and unsatisfactory.

COMPARATIVE EXAMPLE 2

The same titanium-containing cold rolled steel strip as that described in Example 7 was subjected to the same single surface electroplating process as that described in Example 7.

The non-plated surface of the steel strip was treated and subjected to the conversion coating treatment in the same manner as that described in Comparative Example 1.

The resultant conversion coating layer was unsatisfactory.

COMPARATIVE EXAMPLE 3

The same procedures as those described in Example 9 were carried out, except that in the cathodic electrolytic treatment, the cathode current density was 20 A/dm and the electricity quantity 20 C/dm$^2$.

Each resultant treated surface had an oxide layer amount of 5.0 mc/cm$^2$ and a natural reduction time of 350 seconds, and exhibited an unsatisfactory conversion coating property.

We claim:

1. A process for producing cold rolled steel strip highly susceptible to conversion treatments, comprising the steps of:

applying an anodic electrolytic treatment to at least one non-plated surface of a cold rolled steel strip to form a layer of oxides on the non-plated surface; and then applying a cathodic electrolytic treatment to the anodic electrolytically treated surface of said cold rolled steel strip in an aqueous electolyte solution containing at least one member selected from the group consisting of $Na_2SO_4$, $Na_2CO_3$, $K_2SO_4$, $K_2CO_3$, $NaH_2PO_4$, $Na_3HPO_4$, $Na_3PO_4$, and $H_3PO_4$, at a current density of from 1 to 120 A/dm$^2$ with a quantity of electricity of from 0.1 to 150 C/dm$^2$, to remove a portion of the oxide layer to an extent that the remaining portion of the oxide layer is in the form of a number of dots separate from each other, and is an amount corresponding to a quanity of electricity of from 0.05 to 4.0 millicoulomb/cm$^2$ which is necessary to completely dissolve the remaining portion of the oxide layer by means of a cathodic electrolytic treatment in an aqueous solution containing 19.06 g/l of borax and having a pH of 6.4 at a constant current density of 5 microampere/cm$^2$, and corresponding to a natural reduction time of from 1.0 to 200 seconds which is necessary to completely reduce the remaining portion of the oxide layer into the corresponding metal at the natural potential of the oxide layer.

2. The process as claimed in claim 1, wherein said aqueous electrolyte solution has a pH of from 3 to 10.

3. The process as claimed in claim 1, wherein said cold rolled steel strip has been continuously annealed.

4. The process as claimed in claim 1, wherein said cold rolled steel strip contains at least one member selected from titanium, niobium, and boron.

5. A cold rolled steel strip highly susceptible to conversion treatment, produced by the process as claimed in any one of claims 1, 2, 3, or 4.

6. A single surface-plated, cold rolled steel strip highly susceptible to conversion treatment, produced by the process as claimed in any one of claims 1, 2, 3 or 4.

* * * * *